US010010141B2

(12) United States Patent
Hung

(10) Patent No.: US 10,010,141 B2
(45) Date of Patent: Jul. 3, 2018

(54) SAFETY BELT BUCKLE

(71) Applicant: YOKE INDUSTRIAL CORP., Taichung (TW)

(72) Inventor: Wei-Chieh Hung, Taichung (TW)

(73) Assignee: YOKE INDUSTRIAL CORP., Taichung (TW)

( * ) Notice: Subject to any disclaimer, the term of this patent is extended or adjusted under 35 U.S.C. 154(b) by 308 days.

(21) Appl. No.: 14/990,532

(22) Filed: Jan. 7, 2016

(65) Prior Publication Data

US 2017/0196315 A1 Jul. 13, 2017

(51) Int. Cl.
*A44B 11/25* (2006.01)

(52) U.S. Cl.
CPC ..... *A44B 11/2546* (2013.01); *A44B 11/2519* (2013.01); *A44B 11/2561* (2013.01)

(58) Field of Classification Search
CPC ..... A44B 11/2546; A44B 11/2519; A44B 11/2561; A44B 11/2503; A44B 11/2507; A44B 11/25
USPC ..... 24/633, 634, 591.1
See application file for complete search history.

(56) References Cited

U.S. PATENT DOCUMENTS 4,901,407 A * 2/1990 Pandola ..... A44B 11/2576 24/442
2002/0184742 A1* 12/2002 Casebolt ..... A44B 11/253 24/634

* cited by examiner

*Primary Examiner* — Jack W Lavinder
(74) *Attorney, Agent, or Firm* — Tracy M. Heims; Apex Juris, pllc.

(57) ABSTRACT

A safety belt buckle includes a base, a latch, two positioning members, and two elastic members. The base is formed by two symmetrically combined cases, wherein each case includes a first metal core partially clad in a first insulating layer. The latch includes a second metal core, a second insulating layer, and a tongue adapted to insert into a chamber of the base. The two positioning members are pivotally provided on the base and partially located in the chamber. When each positioning member is moved to the first position, a stopper thereof confines the tongue in a locking position to prevent the latch from being separated from the base; when each positioning member is moved to the second position, the stopper thereof is away from the tongue, allowing the latch to be disengaged from the base. The two elastic members push the positioning members toward the first position.

10 Claims, 8 Drawing Sheets

SAFETY BELT BUCKLE

BACKGROUND OF THE INVENTION

1. Technical Field

The present invention relates generally to a safety belt, and more particularly to a safety belt buckle.

2. Description of Related Art

Safety belts are commonly used in keeping people safely secured to fixtures (e.g., seats in vehicles, vessels, and amusement facilities) or safety equipment for extreme sports (e.g., sky diving) and high altitude jobs (e.g. high-rise window cleaning). A conventional safety belt buckle includes a base and a latch which can be engaged with the base, wherein the base and the latch are generally made of metal with heavy duty to avoid being separated by a sudden force after being engaged together.

When the safety belt buckle is not in use, the base and the latch thereof are usually separated, and are respectively bound to two loose belts. Therefore, a safety belt buckle installed on a seat near a power source may be hazardous, for the metal base or latch may accidentally contact the power source, which may cause a short circuit or even serious injuries. In this sense, the conventional safety belt buckle has to be further improved.

BRIEF SUMMARY OF THE INVENTION

In view of the above, the primary objective of the present invention is to provide a safety belt buckle, which has an insulating surface to avoid electrical conduction, and to ensure the safety in use.

The present invention provides a safety belt buckle including a base, a latch, two positioning members, and two elastic members. The base is formed by two symmetrically combined cases, wherein each of the cases includes a first metal core and a first insulating layer, and the first metal core is partially clad in the first insulating layer. A chamber is formed between the two cases, and the base has an opening communicating with the chamber. The latch includes a second metal core and a second insulating layer, wherein the second metal core is partially clad in the second insulating layer. The latch further has a tongue which is adapted to insert into the chamber through the opening. The two positioning members are pivotally provided on the base and partially located in the chamber, wherein each of the two positioning members is pivotally movable between a first position and a second position. Each of the positioning members has a stopper, wherein when the positioning member is moved to the first position, the stopper confines the tongue in a locking position to prevent the latch from being separated from the base; when each of the positioning members is moved to the second position, the stopper thereof is away from the tongue, which allows the latch to be disengaged from the base. The two elastic members are located in the chamber to respectively push the two positioning members toward the first position.

Whereby, with the metal cores which are clad in insulating layers, the safety belt buckle is not only heavy-duty for connection security, but also insulating for preventing harm to users.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
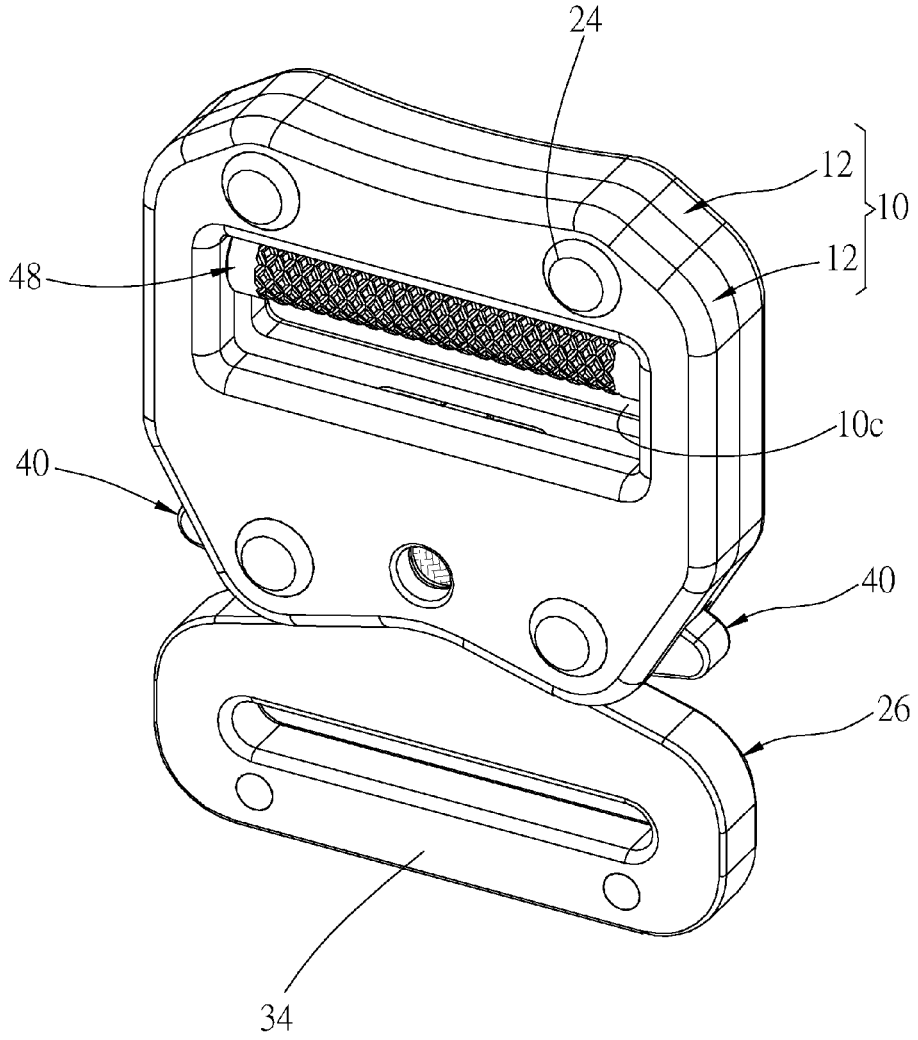
FIG. 1 is a perspective view of a preferred embodiment of the present invention, showing the safety belt buckle.
Figure 2:
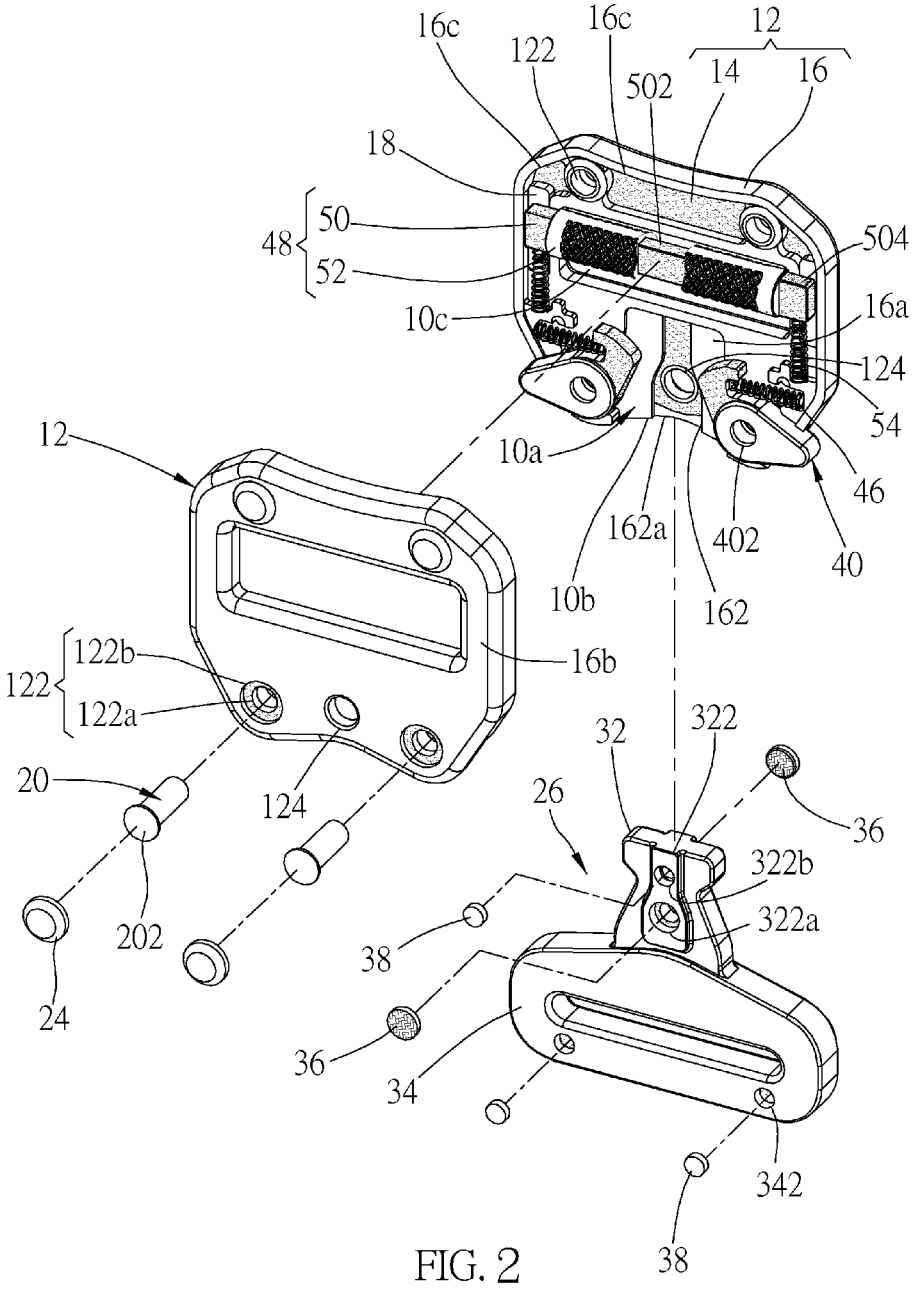
FIG. 2 is a partial exploded view of the safety belt buckle in FIG. 1.
Figure 3:
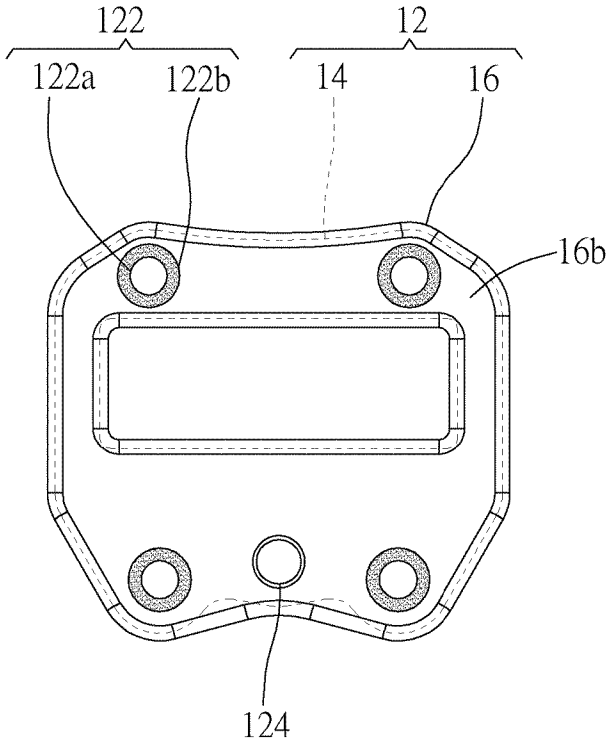
FIG. 3 is a front view of the outer surface of the case of the preferred embodiment.

As shown in FIG. 2 and FIG. 3, the safety belt buckle includes a base 10, a plurality of connecting member 20, a latch 26, two positioning members 40, and a fixing rod 48.

Figure 4:
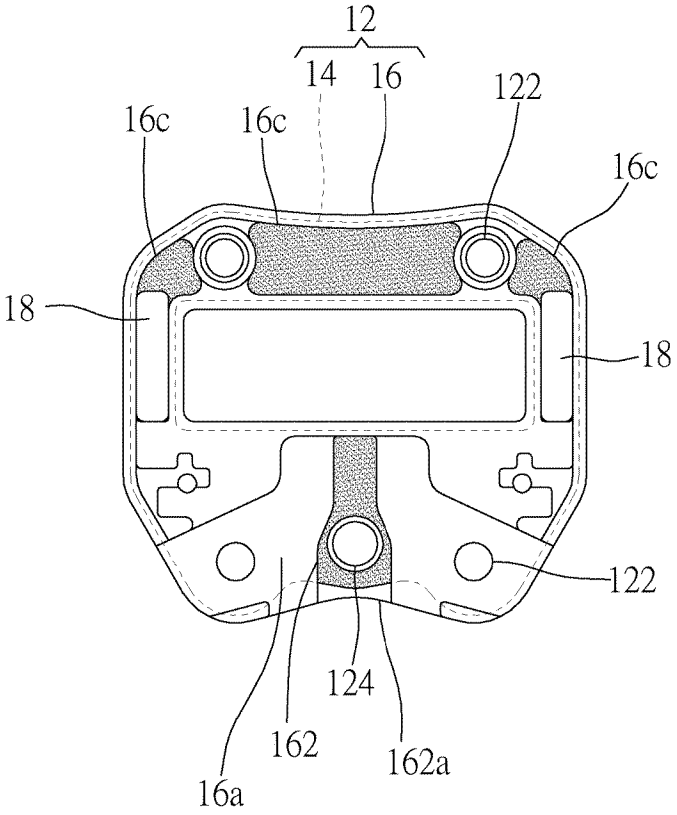
FIG. 4 is a front view of the inner surface of the case of the preferred embodiment.

The base 10 is used for connecting a belt (not shown), and is formed by two symmetrically combined cases 12. In the preferred embodiment, the structures of the two cases 12 are equivalent, wherein each of the cases 12 has an inner surface and an outer surface; the two inner surfaces of the two cases face each other, and the two outer surfaces thereof are opposite to each other. Each of the cases 12 includes a first metal core 14 and a first insulating layer 16, wherein the first metal core 14 is partially clad in the first insulating layer 16, and the first insulating layer 16 is formed by plastic injection molding. A chamber 10*a* is formed between the two cases 12, and the base 10 has an opening 10*b* communicating with the chamber. As illustrated in FIG. 3 and FIG. 4, the first insulating layer 16 of each of the cases 12 has an inner surface 16*a*, wherein the two inner surfaces 16*a* of the two cases 12 form opposite walls which surround the chamber 10*a*. At least one of the cases 12 has a guide groove 162 formed on the inner surface 16*a* thereof. In the preferred embodiment, each of the cases 12 has the guide groove 162, wherein the guide grooves 162 has an open end 162*a* communicating with the opening 10*b*, and each of the first metal core 14 is partially exposed in one of the guide grooves 162. Each of the first insulating layers 16 surrounding the chamber 10*a* further has a plurality of hollow regions 16*c*, wherein the first metal core 14 is partially exposed in the hollow regions 16*c*. The base 10 further has a hollow portion 10*c* formed on the cases 12, and two long-shaped metal blocks 18 are provided in symmetrical two of the hollow regions 16*c* around the hollow portion 10*c*.

Each of the cases 12 has a plurality of perforations 122 therethrough, and the perforations 122 of one of the cases 12 correspond to the perforations 122 of the other case 12, wherein two pairs of corresponding perforations 122 communicate with the chamber 10*a*. Each of the perforations 122 has a first section 122*a* and a second section 122*b* which communicate with each other, wherein the first section 122*a* is formed on the first metal core 14, and the second section 122*b* is a recession formed on an outer surface 16*b* of the relevant first insulating layer 16, which is formed on the outer surface of the case 12. An inner diameter of the second section 122*b* of each of the perforations 122 is greater than an inner diameter of the first section 122*a* thereof, wherein the first metal core 14 is partially exposed in each of the second sections 122*b*. In additional, at least one of the cases 12 has an aperture 124 communicating the guide groove 162 and the chamber 10*a*. In the preferred embodiment, each of the two cases 12 has the aperture 124 corresponding to the aperture 124 of the other case 12.

The connecting members 20 are rivets in the preferred embodiment, and each of which passes through corresponding two perforations 122. Each of the connecting members 20 has two ends, wherein one of the two ends has a head 202 which is located in the second section 122*b* of one of the perforations 122 of one of the cases 12, and abuts against the first metal core 14 of said case 12; the other end is a bending portion (not shown) which is located in the second section 122*b* of the corresponding perforation 122 of the other case 12, and abuts against the first metal core 14 of said other case 12. Therefore, the two cases 12 are fixed to each other by the connecting members 20. Practically, each of the connecting members 20 in another embodiment includes a bolt and a nut, and the two cases 12 are fixed to each other by the bolt and the nut.

For complete insulation of the outer surface of each of the cases 12, a plurality of first insulating members 24 are respectively inserted into the perforations 122 in the preferred embodiment. Each of the first insulating members 24 is made of an insulating material, in the preferred embodiment, the insulating material is plastic. The first insulating members 24 are connected to the first insulating layers 16 of the cases, and seal the perforations 122 to cover the connecting members 20 which are made of metal. Practically, if it is unnecessary for the cases 12 to be totally insulating on the outer surfaces thereof, the first insulating members 24 could be omitted.

Exposed portions of the first metal core 14 of each of the cases 12 which are not clad in the first insulating layer 16 are abutted against by pillars inside a cavity of a mold when the plastic injection molding is proceeding. Additionally, the first section 122*a* formed in the first metal core 14 is provided for the first metal core 14 to position in the cavity. In this sense, a space is formed between the first metal core 14 and the mold so that the first insulating layer 16 is able to cover the first metal core 14 with a predetermined thickness. After the case 12 is completely formed and pulled out of the mold, the exposed portions of the first metal core 14 are formed as well. In the preferred embodiment, the first section 122*a* of each of the perforations 122 is passed through by one of the connecting members 20, and the first metal core 14 exposed in the second section 122*b* is abutted by said connecting member 20; with such design, no any other hollow regions would be formed on the outer surface 16*b* of each of the first insulating layers 16, and it is accordingly unnecessary to cover the hollow regions with any first insulating members.

Figure 5:
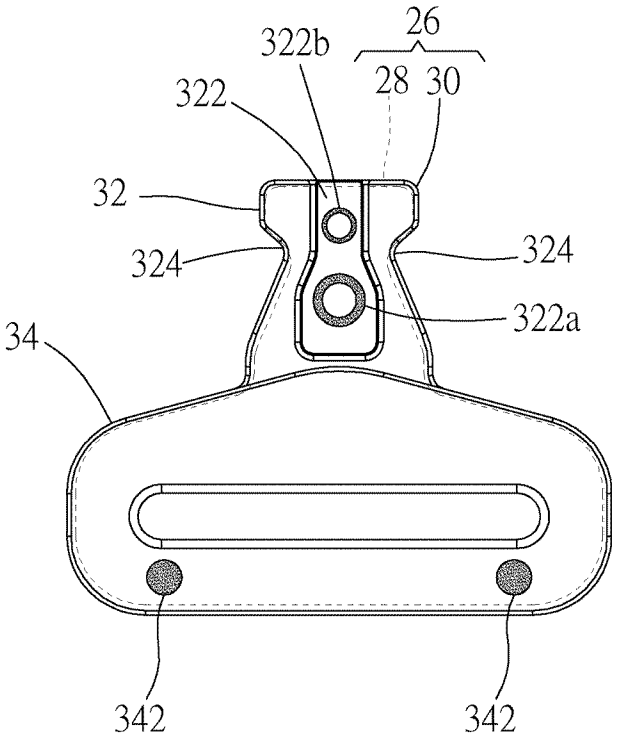
FIG. 5 is a front view of one surface of the latch of the preferred embodiment.
Figure 6:
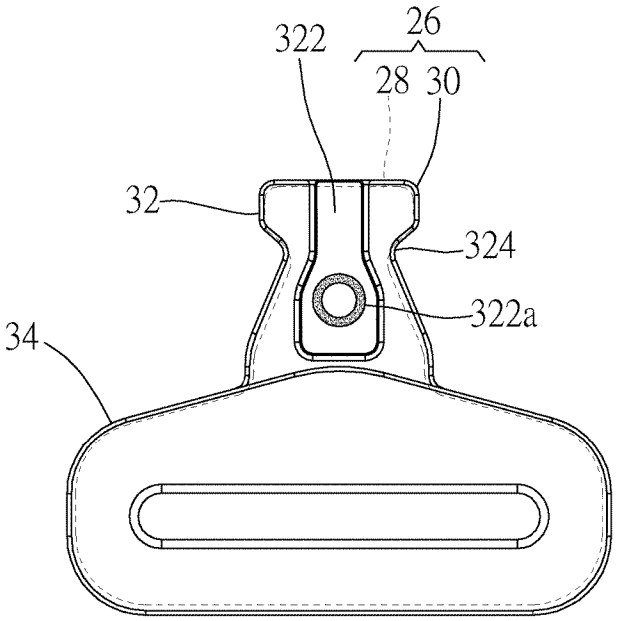
FIG. 6 is a front view of the other surface of the latch of the preferred embodiment.

The latch 26 illustrated in FIG. 5 and FIG. 6 includes a second metal core 28 and a second insulating layer 30, wherein the second metal core 28 is partially clad in the second insulating layer 30, and the second insulating layer 30 is formed by plastic injection molding. Additionally, the latch 26 has a tongue 32 and a grip portion 34, wherein the tongue 32 is adapted to insert into the chamber 10*a* through the opening 10*b* of the base 10, and the grip portion 34 is provided for a user to grip, and is connected to the other belt (not shown). The tongue 32 has a protrusion 322 formed on the second insulating layer 30 on at least one of two opposite surfaces of the tongue 32; in the preferred embodiment, both the opposite surfaces has the protrusions 322, and the shape of each of the protrusions 322 corresponds to the guide groove 162. Each of the protrusions 322 has a first counterbore 322*a* formed on the surface thereof, and the two counterbores 322*a* respectively formed on the opposite protrusions 322 correspond to each other. The second metal core 28 is partially exposed in each of the first counterbores 322*a*, wherein an inner diameter of the first counterbore 322*a* is better to be equal to or smaller than the aperture 124 of the case 12.

Each of the first counterbores 322*a* is inserted by a second insulating member 36 made of an insulating material for being connected to the second insulating layer 30, and sealing one of the first counterbore 322*a*. In addition, at least one of the two corresponding second insulating members 36 has a different color from the second insulating layer 30; in the preferred embodiment, both the two corresponding second insulating members 36 have different colors from the second insulating layer 30. When the tongue 32 is moved to a locking position, the two second insulating members 36 correspond to the apertures 124 of the two cases 12. In this way, the user is able to make sure that the tongue 32 is in the locking position when observing the different color of the second insulating member 36 through the apertures 124. In other words, the second insulating member 36 is used as a positioning mark. In addition, two recessions 324 are symmetrically formed on two sides of the tongue 32.

Moreover, the latch 26 has a plurality of second counterbores 322*b* and 342, and each of which is formed on one of the opposite surfaces of the second insulating layer 30. One of the second counterbores 322*b* is formed on the tongue 32, and two of the second counterbores 342 are formed on the grip portion 34; said second counterbores 322*b* and 342 surround one of the first counterbore 322*a* on the relevant surface of the second insulating layer 30. The second metal core 28 is partially exposed in each of the second counterbores 322*b*, 342. The second counterbores 322*b* and 342 are inserted by a plurality of third insulating members 38, wherein each of which is made of an insulating material, and is connected to the second insulating layer 30 for sealing one of the second counterbores 322*b* and 342.

Exposed portions of the second metal core 28 which are exposed in each of the first counterbores 322*a* and second counterbores 322*b* and 342 are abutted against by pillars inside a cavity of a mold when the plastic injection molding is proceeding. In this sense, a space is formed between the second metal core 28 and the mold so that the second insulating layer 30 is able to cover the second metal core 28 with a predetermined thickness. Afterwards, the case 12 is completely formed and pulled out of the mold, and the exposed portions of the second metal core 28 are formed. Practically, according to the size of the second metal core 28, the pillar of the mold which is used to abut against the second counterbore 322*b* on the tongue 32 could be omitted; in this sense, the second counterbore 322*b* would not be formed on the tongue 32. Additionally, the pillars of the mold which are used to abut against the second counterbores 342 on the grip portion 34 could be omitted as well; in this sense, said second counterbores 342 would not be formed on the grip portion 34.

Figure 7:
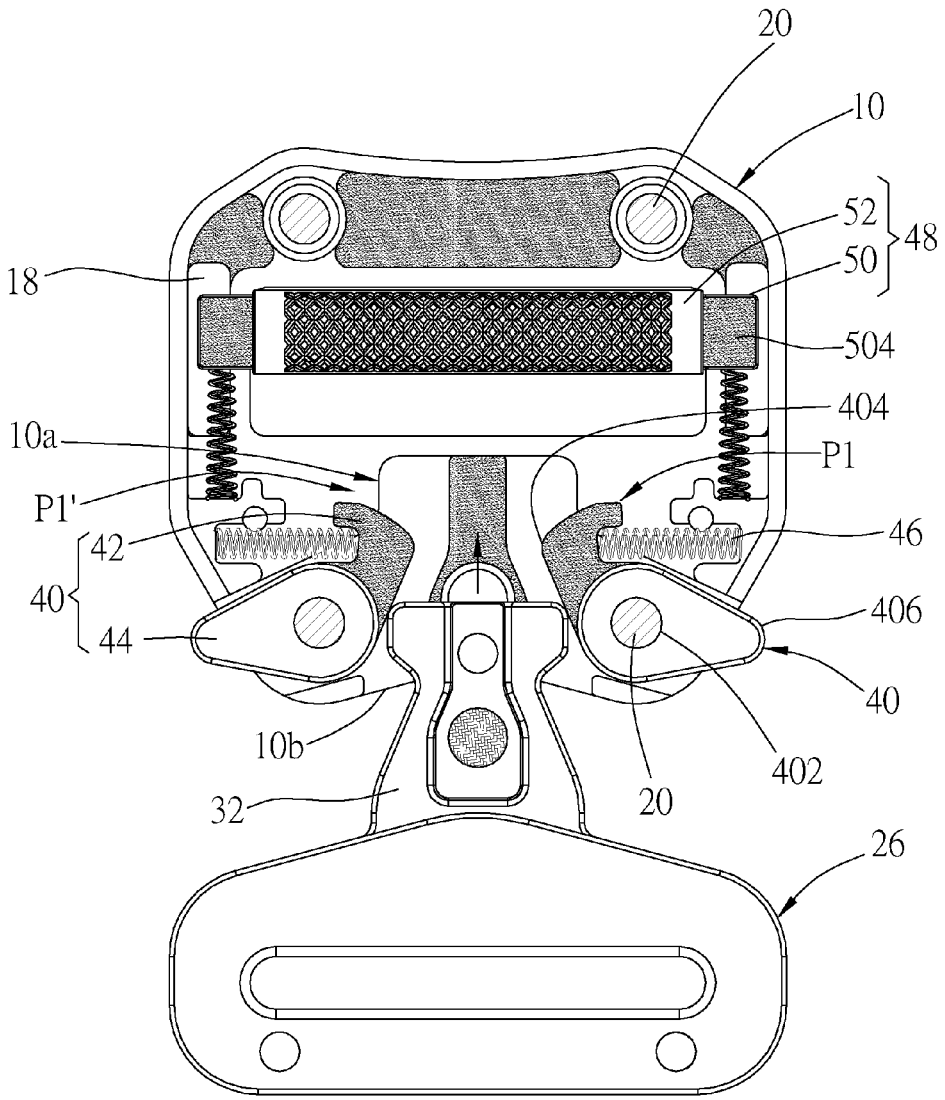
FIG. 7 to FIG. 9 are schematic diagrams of the process of engaging the latch with the base of the preferred embodiment.

As shown in FIG. 7, the two positioning members 40 are partially located in the chamber 10*a*, wherein each of the positioning members 40 includes a third metal core 42 and a third insulating layer 44, and the third metal core 42 is partially clad in the third insulating layer 44 which is formed by plastic injection molding. Each of the positioning members 40 further has a pivoting hole 402, and each of the pivoting holes 402 corresponds to the two corresponding perforations 122 which communicate with the chamber 10*a*. In addition, two of the connecting members 20 respectively pass through the two pivoting holes 402 of the two positioning members 40. Accordingly, the two positioning members 40 are pivotally provided on the base 10, and are pivotally movable between a first position P1 and P1' illustrated in FIG. 7 and a second position P2 and P2' illustrated in FIG. 8. Each of the third metal cores 42 has an exposed portion which is not covered by the third insulating layer 44, and a stopper 404 is formed on said exposed portion; both the two stoppers 404 of the two positioning members 40 are close to the center of the chamber 10*a*. Each of the positioning members 40 further has a control portion 406 which is formed on the third insulating layer 44, and is provided outside the base 10. Each of the positioning members 40 is pivotally movable by an external force exerted on the control portion 406 thereof.

Furthermore, two elastic members are located in the chamber 10*a*; in the preferred embodiment, the elastic members are two first springs 46. Each of the first springs 46 has two opposite ends, wherein one of the ends abuts against a position of one of the positioning members 40 which is opposite to the stopper 404, and the other end abuts against an inner side of the chamber 10*a*. Accordingly, the two first springs 46 respectively push the two positioning members 40 toward the first position P1 and P1'.

The exposed portions of the third metal cores 42 are abutted against by pillars inside a cavity of a mold when the plastic injection molding is proceeding. In this sense, a space is formed between the third metal core 42 and the mold so that the third insulating layer 44 is able to cover the third metal core 42 with a predetermined thickness. The stoppers 404 are formed on the exposed portions of the third metal core 42 to prevent being worn.

The fixing rod 48 includes a fourth metal core 50 and a fourth insulating layer 52, wherein the fourth insulating layer 52 is formed by plastic injection molding. The fourth metal core 50 is rod-shaped, and has a middle bar 502 and two connecting ends 504 which are respectively connected to two ends of the middle bar 502. The middle bar 502 is provided in the hollow portion 10*c* of the base 10, and is clad in the fourth insulating layer 52, while the two connecting ends 504 are not covered by the fourth insulating layer 52. The two connecting ends 504 are movably connected to the base 10, and respectively abut against the two metal blocks 18 which are provided in the hollow regions 16*c* around the hollow portion 10*c*. In addition, the safety belt buckle further has another two elastic members; in the preferred embodiment, the another two elastic members are two second springs 54 which are located inside the two cases 12. Each of the second springs 54 has two opposite ends, wherein the two ends respectively abut against one of the connecting ends 504 and an inner side of one of the cases 12. Accordingly, the second springs 54 push the fixing rod 48 away from the opening 10*b* of the base 10 to clamp the other belt.

The two connecting ends 504 are abutted against by pillars inside a cavity of a mold when the plastic injection molding is proceeding. In this sense, a space is formed between the fourth metal core 50 and the mold so that the fourth insulating layer 52 is able to cover the middle bar 502 with a predetermined thickness. Specifically, the two connecting ends 504 which are easily-worn when the fixing rod 48 is moving on the base 10 are effectively used to be abutted by the pillars.

Figure 8:
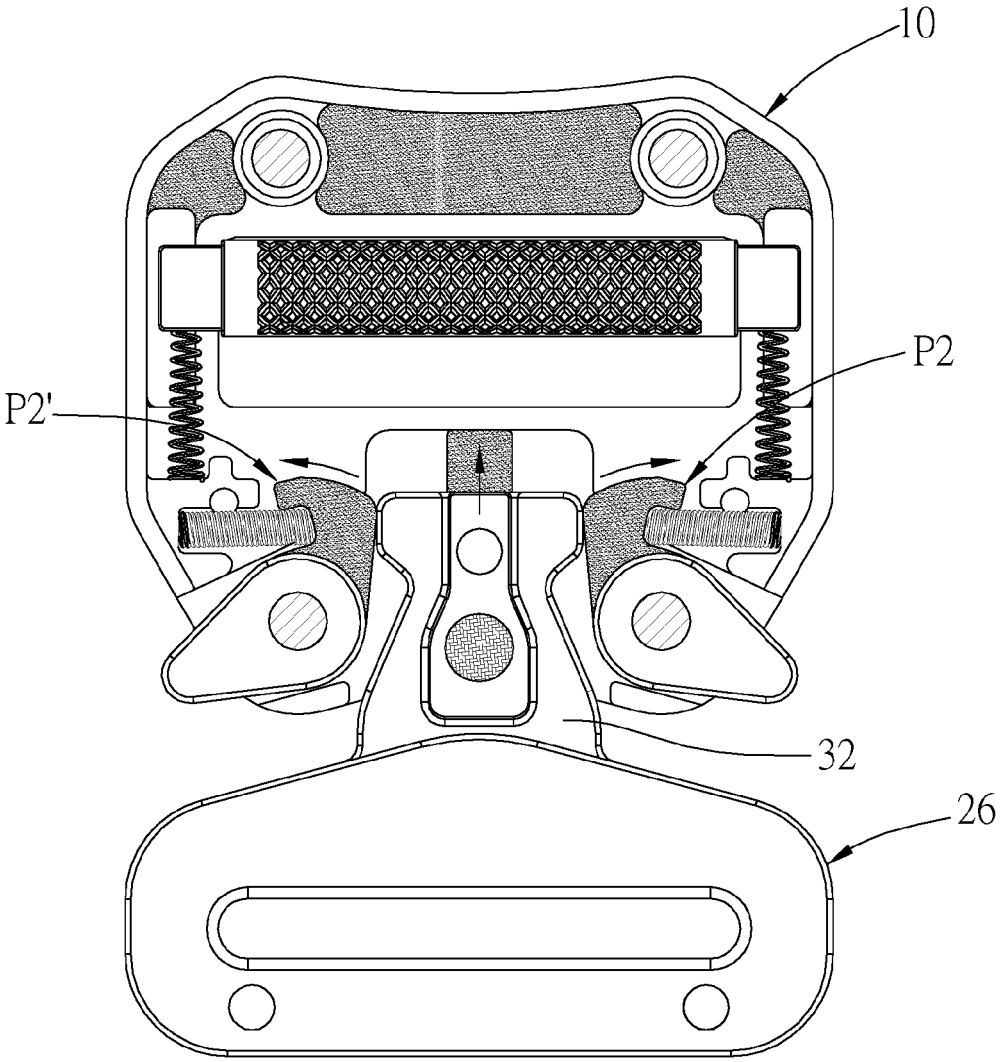
Figure 9:
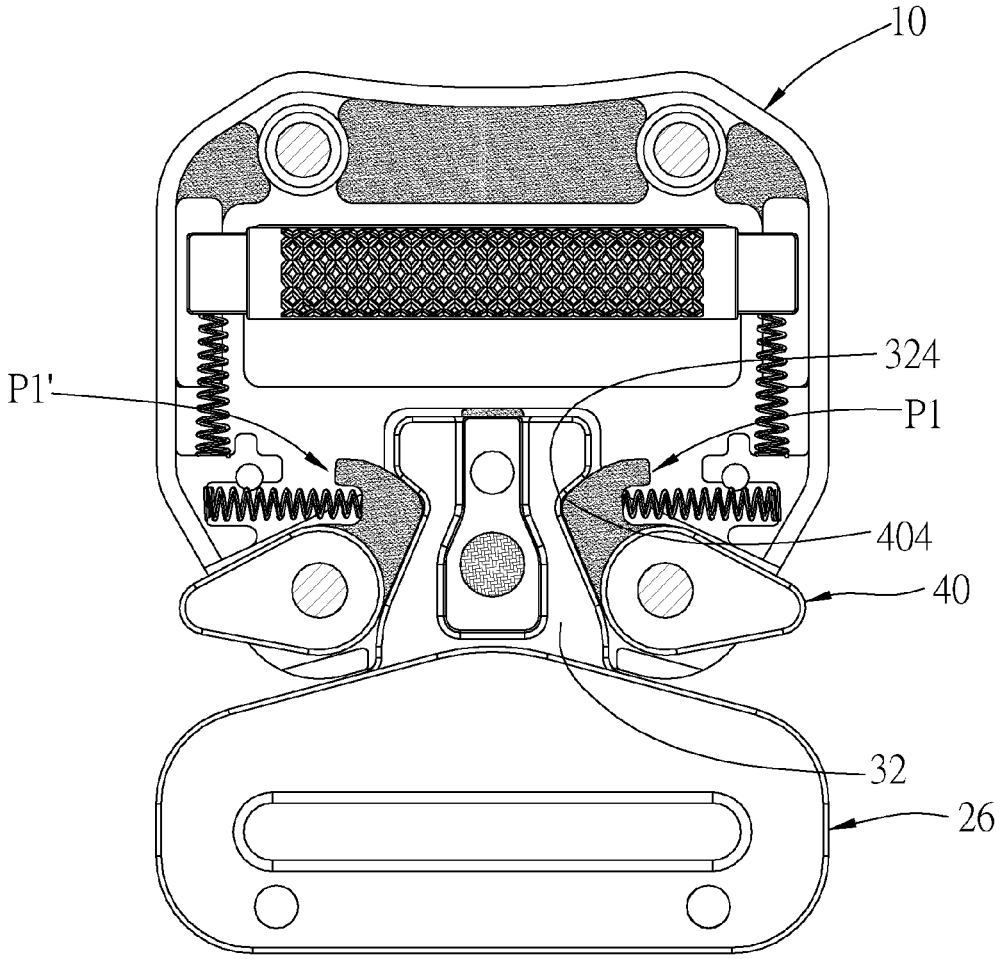
Figure 10:
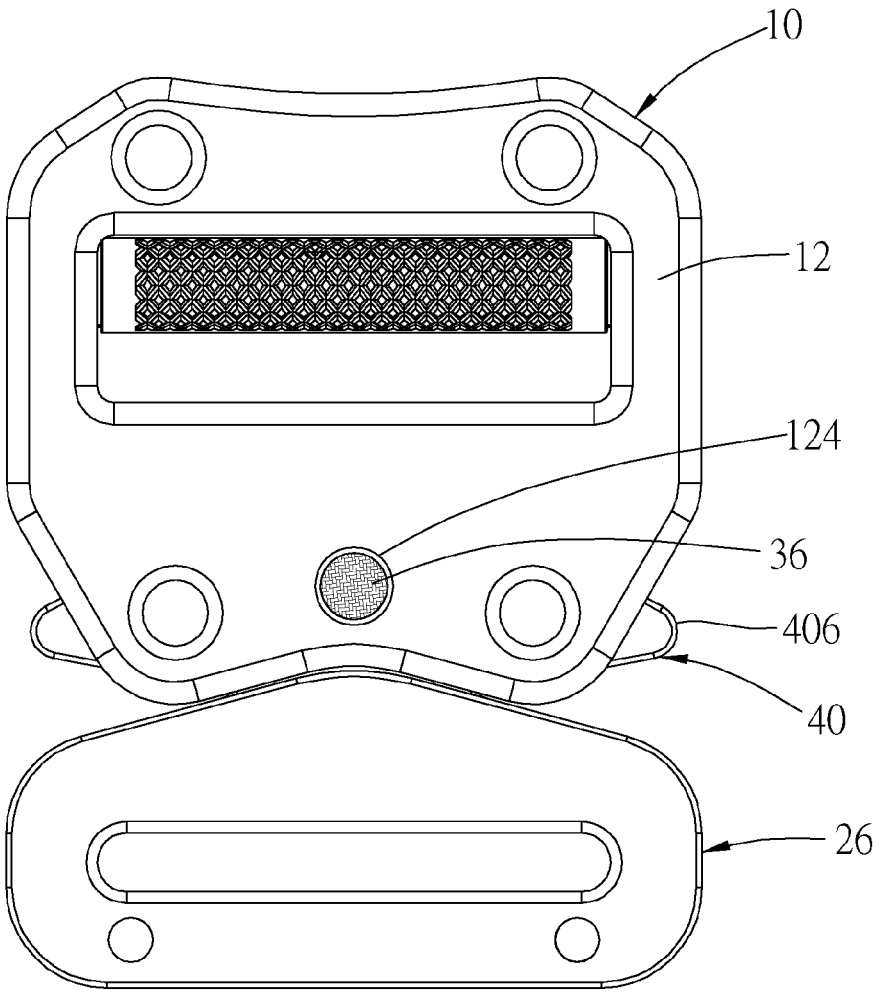
FIG. 10 is a front view of the safety belt buckle in FIG. 1.

The using process of the safety belt buckle is shown in FIG. 7 to FIG. 9. When the tongue 32 of the latch 26 inserts into the chamber 10*a* through the opening 10*b*, the tongue 32 abuts against the exposed portions which are not covered by the third insulating layer 44 of the two positioning members 40, to push the positioning members 40 toward the second position P2 and P2' from the first position P1 and P1' as depicted in FIG. 7 and FIG. 8. When the tongue 32 is moved to the locking position as shown in FIG. 9, the first springs 46 push the positioning members 40 to the first position P1 and P1', and the two stoppers 404 of the two positioning members 40 are positioned in the two recessions 324 of the tongue 32, to confines the tongue 32 in a locking position to prevent the latch 26 from being separated from the base 10. In the above locking stage, the second insulating member 36 could be completely observed through the aperture 124 of the case 12 as shown in FIG. 10 for the user to make sure that the tongue 32 is in the locking position. Particularly, the protrusion 322 of the tongue 32 corresponds to the guide groove 162 of the case 12 to confine the tongue 32 in the locking position fixedly.

The latch 26 could be disengaged from the base 10 after the control portions 406 of the positioning members 40 are pushed to the second position P2, P2'. Therefore, the stoppers 404 are away from the recessions 324 of the tongue 32 to allow the tongue 32 to be separated from the base 10.

In conclusion, the cores of the safety belt buckle are made of metal, and are clad in insulating layers, which is not only heavy-duty for connection security, but insulating for ensuring the safety in use. Furthermore, the exposed portions of the metal cores resulting from the plastic injection molding are used for specific function additionally.

It must be pointed out that the embodiments described above are only some preferred embodiments of the present invention. All equivalent structures which employ the concepts disclosed in this specification and the appended claims should fall within the scope of the present invention.

What is claimed is:

1. A safety belt buckle, comprising:

a base formed by two symmetrically combined cases, wherein each of the cases comprises a first metal core and a first insulating layer, and the first metal core is partially clad in the first insulating layer; a chamber is formed between the two cases, and the base has an opening communicating with the chamber;

a latch comprising a second metal core and a second insulating layer, wherein the second metal core is partially clad in the second insulating layer; the latch further has a tongue which is adapted to insert into the chamber through the opening;

two positioning members pivotally provided on the base and partially located in the chamber, wherein each of the two positioning members is pivotally movable between a first position and a second position; each of the positioning members has a stopper, wherein when the positioning member is moved to the first position, the stopper confines the tongue in a locking position to prevent the latch from being separated from the base; when each of the positioning members is moved to the second position, the stopper thereof is away from the tongue, which allows the latch to be disengaged from the base; and two elastic members located in the chamber to respectively push the two positioning members toward the first position;

wherein each of the two cases has a plurality of perforations, and the perforations of one of the cases correspond to the perforations of the other case; the first insulating layer of each of the cases has an outer surface; the two outer surfaces of the two cases are opposite to each other; each of the perforations has a first section and a second section which communicate with each other, wherein the first section is formed on the first metal core, and the second section is a recession formed on the outer surface of the relevant first insulating layer; an inner diameter of the second section of each of the perforations is greater than an inner diameter of the first section thereof, wherein the first metal core is partially exposed in each of the second sections.

2. The safety belt buckle of claim 1, wherein the safety belt buckle further has a plurality of connecting members, wherein each of which is fitted in one of the perforations of one of the cases and the corresponding perforation of the other case; each of the connecting members has two ends, wherein one of the two ends is located in the second section of one of the perforations of one of the cases, and abuts against the corresponding first metal core of said case; the other end is located in the second section of one of the perforations of the other case, and abuts against the corresponding first metal core of said other case.

3. The safety belt buckle of claim 2, wherein each of the two positioning members has a pivoting hole; two of the connecting members respectively pass through the two pivoting holes of the two positioning members.

4. The safety belt buckle of claim 1, further comprising a plurality of first insulating members made of an insulating material, wherein each of the first insulating members is connected to one of the cases, and seals one of the perforations through the second section thereof.

5. A safety belt buckle, comprising:

a base formed by two symmetrically combined cases, wherein each of the cases comprises a first metal core and a first insulating layer, and the first metal core is partially clad in the first insulating layer; a chamber is formed between the two cases, and the base has an opening communicating with the chamber;

a latch comprising a second metal core and a second insulating layer, wherein the second metal core is partially clad in the second insulating layer; the latch further has a tongue which is adapted to insert into the chamber through the opening;

two positioning members pivotally provided on the base and partially located in the chamber, wherein each of the two positioning members is pivotally movable between a first position and a second position; each of the positioning members has a stopper, wherein when the positioning member is moved to the first position, the stopper confines the tongue in a locking position to prevent the latch from being separated from the base; when each of the positioning members is moved to the second position, the stopper thereof is away from the tongue, which allows the latch to be disengaged from the base; and two elastic members located in the chamber to respectively push the two positioning members toward the first position;

two second insulating members made of an insulating material; the tongue of the latch has two first counterbores on two opposite sides thereof, wherein each of the first counterbores is formed on an outer surface of the second insulating layer, and the second metal core is partially exposed in each of the first counterbores; each of the second insulating members is connected to the latch, and seals one of the first counterbores.

6. The safety belt buckle of claim 5, wherein at least one of the two cases has an aperture communicating the chamber; the two first counterbores are arranged correspondingly; at least one of the two second insulating members has a different color from the second insulating layer; when the tongue is moved to the locking position, the second insulating member which has the different color corresponds to the aperture.

7. The safety belt buckle of claim 5, further comprising a plurality of third insulating members made of an insulating material; the latch has a plurality of second counterbores, and each of which is formed on the outer surface of the second insulating layer, and the second metal core is partially exposed in each of the second counterbores; each of the third insulating members is connected to the latch, and seals one of the second counterbores.

8. A safety belt buckle, comprising:

a base formed by two symmetrically combined cases, wherein each of the cases comprises a first metal core and a first insulating layer, and the first metal core is partially clad in the first insulating layer; a chamber is formed between the two cases, and the base has an opening communicating with the chamber;

a latch comprising a second metal core and a second insulating layer, wherein the second metal core is partially clad in the second insulating layer; the latch further has a tongue which is adapted to insert into the chamber through the opening;

two positioning members pivotally provided on the base and partially located in the chamber, wherein each of the two positioning members is pivotally movable between a first position and a second position; each of the positioning members has a stopper, wherein when the positioning member is moved to the first position, the stopper confines the tongue in a locking position to prevent the latch from being separated from the base; when each of the positioning members is moved to the second position, the stopper thereof is away from the tongue, which allows the latch to be disengaged from the base; and two elastic members located in the chamber to respectively push the two positioning members toward the first position;

wherein the first insulating layer of each of the two cases has an inner surface; the two inner surfaces of the two cases face each other, and form two walls of the chamber, wherein one of the cases has a guide groove which is formed on the inner surface thereon; the first metal core is partially exposed in the guide groove; the tongue of the latch has a protrusion formed on the second insulating layer, which corresponds to the guide groove.

9. A safety belt buckle, comprising:

a base formed by two symmetrically combined cases, wherein each of the cases comprises a first metal core and a first insulating layer, and the first metal core is partially clad in the first insulating layer; a chamber is formed between the two cases, and the base has an opening communicating with the chamber;

a latch comprising a second metal core and a second insulating layer, wherein the second metal core is partially clad in the second insulating layer; the latch further has a tongue which is adapted to insert into the chamber through the opening;

two positioning members pivotally provided on the base and partially located in the chamber, wherein each of the two positioning members is pivotally movable between a first position and a second position; each of the positioning members has a stopper, wherein when the positioning member is moved to the first position, the stopper confines the tongue in a locking position to prevent the latch from being separated from the base; when each of the positioning members is moved to the second position, the stopper thereof is away from the tongue, which allows the latch to be disengaged from the base; and two elastic members located in the chamber to respectively push the two positioning members toward the first position;

wherein each of the positioning members comprises a third metal core and a third insulating layer, and the third metal core is partially clad in the third insulating layer; each of the stoppers is provided on one of the third metal core without being covered by the third insulating layer; each of the positioning member further has a control portion, wherein each of the control portions is provided outside the base, and each of the positioning members is pivotally movable by an external force exerted on the control portion thereof; each of the control portions is provided on the third insulating layer.

10. A safety belt buckle, comprising:

a base formed by two symmetrically combined cases, wherein each of the cases comprises a first metal core and a first insulating layer, and the first metal core is partially clad in the first insulating layer; a chamber is formed between the two cases, and the base has an opening communicating with the chamber;

a latch comprising a second metal core and a second insulating layer, wherein the second metal core is partially clad in the second insulating layer; the latch further has a tongue which is adapted to insert into the chamber through the opening;

two positioning members pivotally provided on the base and partially located in the chamber, wherein each of the two positioning members is pivotally movable between a first position and a second position; each of the positioning members has a stopper, wherein when the positioning member is moved to the first position, the stopper confines the tongue in a locking position to prevent the latch from being separated from the base; when each of the positioning members is moved to the second position, the stopper thereof is away from the tongue, which allows the latch to be disengaged from the base; and two elastic members located in the chamber to respectively push the two positioning members toward the first position;

wherein the base has a hollow portion; the safety belt buckle further comprises a fixing rod which comprises a fourth metal core and a fourth insulating layer, wherein the fixing rod comprises a middle bar and two connecting ends which are respectively connected to two ends of the middle bar; the middle bar is provided in the hollow portion, and is clad in the fourth insulating layer; the two connecting ends are movably connected to the base without being covered by the fourth insulating layer.

* * * * *